US008181498B2

(12) United States Patent
Tocco

(10) Patent No.: US 8,181,498 B2
(45) Date of Patent: May 22, 2012

(54) METHOD AND APPARATUS FOR SHAPING A RIM OF A THREE-DIMENSIONALLY ARCHED SHEET METAL

(75) Inventor: Christian Joel Tocco, Holly, MI (US)

(73) Assignee: EDAG, Inc., Auburn Hills, MI (US)

( * ) Notice: Subject to any disclaimer, the term of this patent is extended or adjusted under 35 U.S.C. 154(b) by 1020 days.

(21) Appl. No.: 12/134,773

(22) Filed: Jun. 6, 2008

(65) Prior Publication Data

US 2009/0301154 A1 Dec. 10, 2009

(51) Int. Cl.
*B21D 7/00* (2006.01)

(52) U.S. Cl. ..... 72/101; 72/91; 72/215; 72/704; 72/705

(58) Field of Classification Search ..... 72/704, 72/705, 220, 379.2, 15–217, 224, 380, 381, 72/386, 389.1
See application file for complete search history.

(56) References Cited

U.S. PATENT DOCUMENTS

| | | | | |
|---|---|---|---|---|
| 5,852,873 | A * | 12/1998 | Pollkotter | 72/110 |
| 6,505,490 | B2 * | 1/2003 | Hodjat et al. | 72/84 |
| 6,644,083 | B2 * | 11/2003 | Pakker | 72/379.2 |
| 2005/0086989 | A1 * | 4/2005 | Holmgren et al. | 72/220 |

* cited by examiner

*Primary Examiner* — Edward Tolan
*Assistant Examiner* — Pradeep C Battula
(74) *Attorney, Agent, or Firm* — RatnerPrestia

(57) ABSTRACT

Method for shaping a rim of a three dimensionally arched sheet metal, wherein the sheet metal is placed on a female die provided with a chamfer which follows the contour of a peripheral edge of the rim, the rim spanning the chamfer, and a male roller die is rolled on the sheet metal following the course of the chamfer while being pressed against the rim, thereby plastically deforming the rim locally into the chamfer while advancing along the chamfer in rolling contact.

19 Claims, 4 Drawing Sheets

METHOD AND APPARATUS FOR SHAPING A RIM OF A THREE-DIMENSIONALLY ARCHED SHEET METAL

BACKGROUND OF THE INVENTION

The invention is directed to the shaping of a rim of a sheet metal which is three-dimensionally arched, and is in particular directed to shaping a rim of a sheet metal component to be attached to or being already part of a vehicle, the vehicle preferably being an automobile.

Sheet metal components of automobiles are usually three-dimensionally arched or shaped for example by deep-drawing a flat sheet metal. Such components have peripheral edges which might be sharp or of an anaesthetic appearance. In other cases, the rim of such components, including the peripheral edge, needs to be stiffened in order to maintain the desired shape under regular operating conditions. Conventionally the rims are shaped manually by flanging along the respective peripheral edge.

SUMMARY OF THE INVENTION

It is desirable to enable shaping of a rim along a curved edge of a three-dimensionally arched sheet metal in improved quality and cost-effectiveness to be applicable in series production.

In one aspect, the present invention is a method for shaping a rim of a three-dimensionally arched sheet metal, the method comprising the steps of placing the sheet metal on a female die which is provided with a chamfer which follows the contour of a peripheral edge of the rim. The edge comprises one or more curved section(s) or is curved all over its course. The edge may be curved only in one plane or in all three dimensions. The sheet metal is placed on the female die such that the rim spans the chamfer. The sheet metal my bear on the die with its weight, in principal however the die may be oriented vertically or almost vertically or may even be oriented such that the sheet metal is placed on a die surface from below. With the sheet metal placed on the female die, a male roller die is rolled on the sheet metal following the course of the chamfer while being pressed against the rim in a rim zone which spans the chamfer. Thereby the rim is plastically deformed into the chamfer locally, namely at the momentary place of rolling contact of the male roller die advancing on the rim along the chamfer. The sheet metal is deformed into the cavity provided by the chamfer in a forming process comparable to deep-drawing, but only in principal, since the forming process of the invention effects only a local deformation which advances, as the roller die does, and is therefore a very gentle forming process resulting in the formation of a dent along the sheet metal rim.

Use of a female die and a male roller die guarantees high reproducibility in shape. A roller die is not restricted to a certain course of a rim but can flexibly be used to shape rims of different courses, in particular if the roller die is part of a tool head arranged to be connected to an actor which is movable in space, for example, a robot arm.

In at least one embodiment, the rim comprises an inner rim zone spanning the chamfer and a peripheral rim zone which includes the peripheral edge and protrudes beyond the chamfer and preferably protrudes beyond the female die freely to improve accessibility. In an embodiment of the method, a back-up roller is rolled along the peripheral rim zone pressed against the peripheral rim zone towards the male roller die. The peripheral rim zone is backed-up by this action of the back-up roller, while the male roller die is pressed in a rolling contact against the inner rim zone. So the male roller die exerts a pressure force on the rim towards the female die while the back-up roller is in rolling contact with the peripheral rim zone in the vicinity of the place of momentary rolling contact of the male roller die. This way the male roller die also serves the purpose of a down holder for the back-up roller. It is advantageous if the sheet metal is already deformed into the chamfer during this combined roller action. A region in which a circumferential working surface of the male roller die meets with a face side of the male roller die may serve as a block against which the rim is in abutment to better define a flanging edge about which the rim is flanged while advancing the male roller die and the back-up roller, the flanging edge extending between the inner rim zone and the peripheral rim zone. The flanging edge is best defined if the peripheral rim zone is backed-up while the inner rim zone is actually or has already been deformed into the chamfer completely, i.e. is in abutment with the surface of the chamfer all over the chamfer's cross-section. Preferably, the male roller die is just deforming the inner rim zone in such a complete abutment while the peripheral rim zone is backed-up by the back-up roller.

The chamfer has two opposed side walls. The side wall being closer to a protruding peripheral edge of the rim and facing away from that edge is advantageously shaped such that it ends, at the rim where the chamfer transitions into the surface of the female die, parallel or at least almost parallel to the pressure force exerted by the male roller die in its rolling contact. Such a shape is advantageous for backing-up the peripheral rim zone and, furthermore, for a subsequent further flanging process in which the peripheral rim zone is bent back towards the chamfer by means of a hem roller. Subsequently bending back the peripheral rim zone is not necessarily the subject of the invention but is an advantageous further development in order to improve in particular the rim's appearance further.

As mentioned, the invention can advantageously be combined with a flanging process which is performed subsequent to the forming process in which the rim is deformed into the chamfer. In such a further development, after having deformed the rim into the chamfer, the male roller die is moved out of its previous working area and a hem roller is positioned to press against a surface of the sheet metal opposed to the surface against which the male roller die has been pressed before. The hem roller is now rolled along the peripheral rim zone following the course of the chamfer and acts on the peripheral rim zone such that it is bent back towards the chamfer. This flanging process is preferably carried out only subsequent to a back-up process, preferred features of which have been outlined above. The bending-back process may be carried out in only one roll pass of the hem roller or, preferably, in several passes, for example two or three passes, in order to bend back the peripheral rim zone so far that the peripheral edge protrudes into the cavity of the dent formed by deforming the rim into the chamfer. This covers embodiments in which the peripheral edge is only in a partial overlap with an opposing rim of the dent. It may be desirable that the peripheral edge is flush with this rim, a small clearance remaining between the peripheral edge and the rim of the dent.

In another aspect, the present invention provides an apparatus for shaping the rim, suited in particular for carrying out the method of the invention. The apparatus comprises a female die with a chamfer in a die surface on which the sheet metal can be placed, and a tool head arranged for being fastened to an actor of a robot. The robot can be an industrial robot with a robot base and a robot arm protruding therefrom.

The base can be stationary in a working area of the robot. In most applications the actor is the end of the robot arm. The actor is preferably movable in space in all six degrees of freedom with respect to motion. The tool head comprises a male roller die shaped to mate with the chamfer for deforming the sheet metal into the chamfer by advancing the roller die in the course of the chamfer in a rolling contact with the sheet metal rim. The female die and the male roller die can advantageously be shaped and arranged to operate as outlined with respect to the method. The features already disclosed with respect to shape and arrangement are also preferred features of the apparatus.

The rim may be deformed into the chamfer in only one roller pass of the male roller die. In preferred embodiments, however, the forming process of deforming the rim into the chamfer is performed in more than one roller pass, either with different male roller dies or preferably with the same male roller die. Deforming into the chamfer in more than one pass is advantageous with respect to quality since the forming process can be performed more gentle per pass. An advantageous compromise between quality requirements and time constraints is achieved when the rim is deformed into the chamfer in two or three roll passes. Also, two or three male roller dies may be arranged on the tool head in a tandem or triple arrangement, one following the other in the direction of advancement and all acting on the rim in the same roll pass.

In at least one embodiment, the tool head further comprises a back-up roller disposed aside, preferably adjacent to the male roller die. The axis of rotation of the back-up roller is inclined with respect to the axis of rotation of the male roller die such that a circumferential working surface of the back-up roller is facing a face side of the male roller die. The axes can be inclined under an angle of 90°, preferably they are inclined at an angle smaller than 90° e.g. an angle in the range of 30° to 70°. The arrangement is such that the male roller die can roll on a first surface of the sheet metal rim while the back-up roller rolls on a second surface of this rim, the surfaces being disposed on opposite sides of the sheet material and being inclined one relative to the other, at least after the back-up roller has acted on the second surface. Most preferred, the first surface is a surface of the inner rim zone and the second surface is a surface of the peripheral rim zone. The axes of rotation may extend in two different planes, although not preferred. In such embodiments the planes are parallel with only a small offset. If such an offset is present, the back-up roller is arranged such that it closely follows the male roller die during advancement along the course of the chamfer. Expediently the axes of the rollers are extending in the same plane.

In another embodiment, the back-up roller is movably supported on the tool head to be adjustable with respect to the male roller die. In such embodiments, the tool head further comprises an adjusting unit coupled with the back-up roller to adjust the position of the backup roller. The back-up roller is preferably movable in the plane of its axis of rotation and in at least one degree of freedom with respect to motion, which can be a translational or rotational degree of freedom. The invention uses the word "or" in it's usual logical meaning, i.e. as an "inclusive or" covering the meaning of "either: or" as well as the meaning of "and", as long as the respective context does under no circumstances allow for one of the two meanings. So the back-up roller may be movably supported on the tool head and accordingly be adjustable in only one translational, only one rotational, one translational and one rotational or in two translational and one rotational degree of freedom in that plane. Preferably, the back-up roller is movable back and forth parallel to the axis of rotation of the male roller die. Such a movability is advantageous for adjusting the position to adapt for varying thicknesses of different metal sheets or the same metal sheet and also for moving the back-up roller so far apart from the male roller die that is cannot interfere when positioning the tool head on the sheet metal or in a preforming roll pass of the male roller die, which can in particular be a first roll pass of the male roller die.

A preferred apparatus comprises a hem roller arranged such that the male roller die and the hem roller can selectively be used to act on the sheet metal.

The method can be carried out, in particular, with the female die being stationary and the roller or several rollers mentioned before being moved in space during the forming process or the several forming processes, i.e. the deforming into the chamfer, the backing-up and the bending back. Alternatively, the roller or several rollers can be kept stationary while the female die is moved in space to pass it together with the sheet metal along the stationary roller(s) according to the course of the chamfer. In yet another alternative embodiment the female die can be also a roller die and can even be a roller die arranged on another or the same tool head of the apparatus of the invention such that the circumferential working surfaces of the female roller die and the male roller die are opposedly facing one another.

A tool head comprising the male die roller and the back-up roller is advantageous as such, not only in combination with the female die, but is however a preferred subject-matter in combination with the female die.

Lastly, the invention is also concerned with a sheet metal component with a rim which has been shaped by the method of the invention. Subject-matter is the component as such before assembling and also in the assembled state forming part of a higher-level assembly. Particularly, the component can be part of or intended for attachment to a vehicle, preferably an automobile. A preferred example of such a component is a fender of or for an automobile. Most preferred applications are retro-style automobiles.

BRIEF DESCRIPTION OF THE DRAWINGS (IF APPLICABLE)

A preferred example embodiment of the invention will now be explained and shown in figures. There are shown:

DETAILED DESCRIPTION OF THE INVENTION

Although the invention is illustrated and described herein with reference to specific embodiments, the invention is not intended to be limited to the details shown. Rather, various modifications may be made in the details within the scope and range of equivalents of the claims and without departing from the invention.

Figure 1:
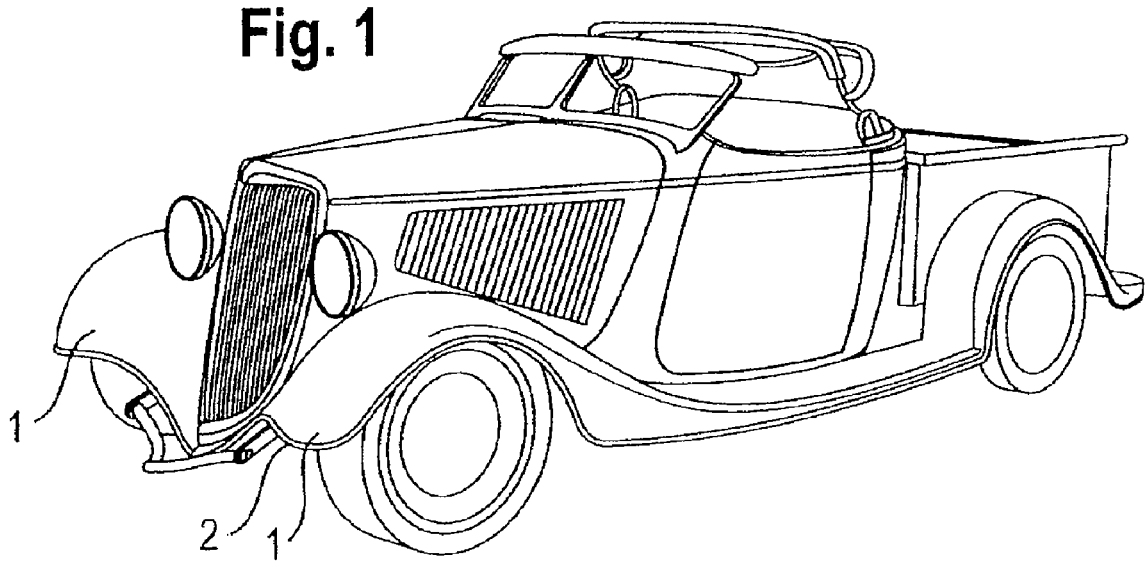
FIG. 1 is an exemplary automobile having fenders with rims shaped according to the invention.

FIG. 1 shows a retro-style automobile having fenders 1 attached to an automobile body. The fenders 1 are three-dimensionally arched sheet metal components each with a shaped rim 2 along its peripheral edge. The rim 2 is shaped as a softly curved dent which does not only stiffen the respective fender 1 but also improves the overall appearance. The rims 2 are shaped in an automated process, which delivers high quality shaping and meets the needs of series production.

Figure 2:
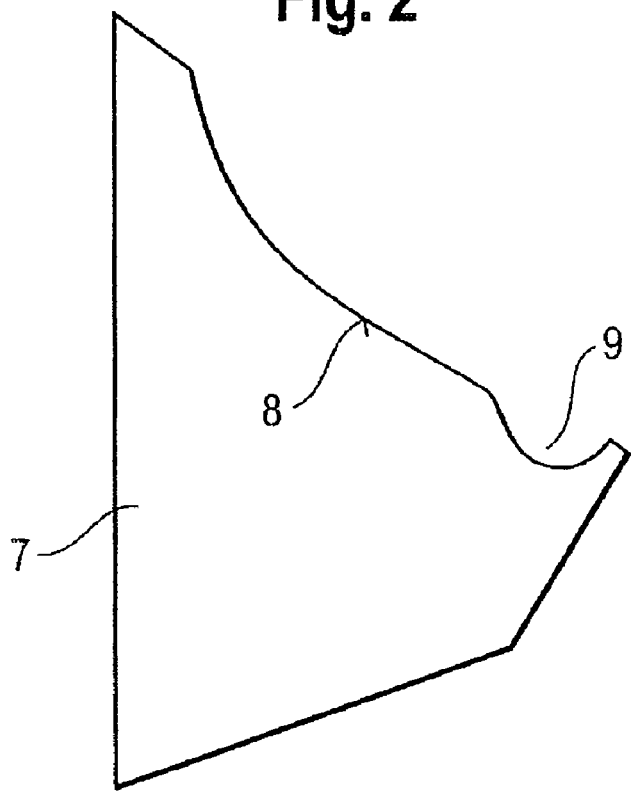
FIG. 2 is a side elevation view of a female die of an apparatus according to the invention.
Figure 3:
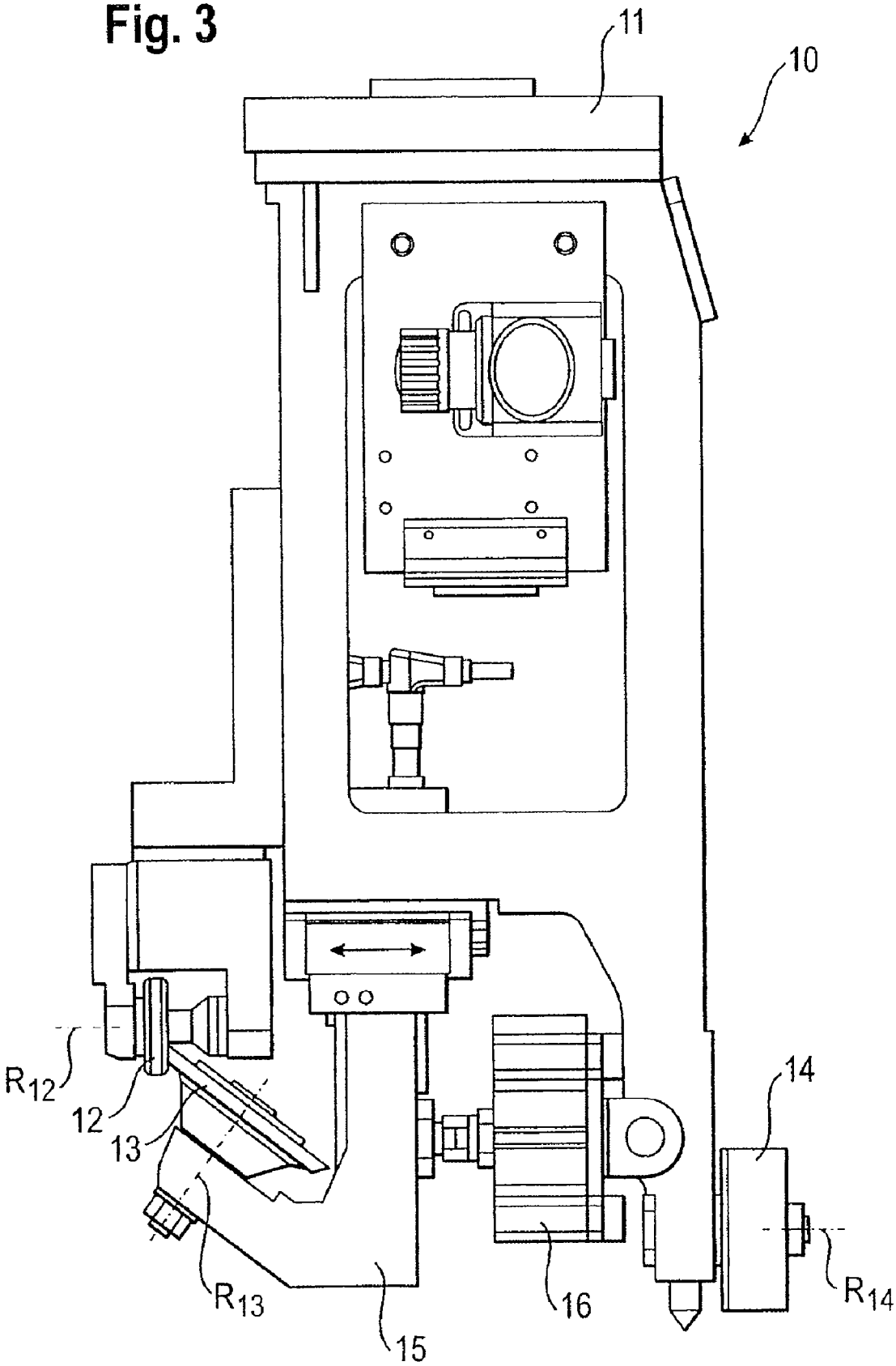
FIG. 3 is a side elevation view of a tool head of the apparatus according to the invention.

An apparatus for carrying out the process is composed of a female die 7, shown in FIG. 2, and a tool head 10 comprising a male roller die 12, shown in FIG. 3.

The female die 7 comprises a surface 8 adapted to the shape of a three-dimensionally arched sheet metal. In the example given above the sheet metal is one of the fenders 1 and is therefore referred to as sheet metal 1 in the following. The female die 7 furthermore comprises a chamfer 9 in the surface 8, the chamfer 9 being close to one edge of the female die 7. The chamfer 9, and also the free die edge in its vicinity, follows the contour of a peripheral edge of the rim 2 of the sheet metal 1. For the sheet metal 1 being one of the fenders 1 the course of the chamfer 9 is a three dimensional curve.

In the example embodiment the chamfer 9 has a width which is larger than its depth, as is preferred not only for the example of the sheet metal 1 being a fender of an automobile but also in general for carrying out the method of the invention. The chamfer 9 has a cross-section which is preferably the same over the whole length of the chamfer 9. The chamfer 9 may have a width in the range from e.g. 5 mm to e.g. 50 mm, the width preferably being constant over the length of the chamfer 9.

The tool head 10 comprises a fastening member 11 for fastening the tool head 10 to the end of a robot arm. The fastening member 11 preferably provides not only for mechanical fastening but also for supply of the tool head 10 with media required for its operation, for example electrical energy, control signals or pressure fluid. The fastening member 11 can in particular be a docking member for an automatic docking and separating to and from the robot arm. The tool head 10 comprises a male roller die 12 mounted to be rotatable about a roller axis R12. The roller axis R12 can be stationary on the tool head 10. The roller die 12 has a circumferential working surface in a shape which mates with the chamfer 9 in order to operate as the male die part to the female die 7.

The tool head 10 comprises in addition a back-up roller 13 mounted rotatably about its roller axis R13 and furthermore movable as a whole relative to the male roller die 12. The back-up roller 13 can be moved back and forth between a working position, shown in FIG. 3, and a non-working position in which it is further away from the male roller die 12. To be movable as a whole the back-up roller 13 is mounted rotatably about its roller axis R13 by a support structure 15 which is movable back and forth such that by this movement the back-up roller 13 is moved in and out of its working position. In the example embodiment the support structure 15 is a slide being movable along an axis which is parallel to the roller axis R12. The tool head 10 also comprises an adjustment unit 16 to position the back-up roller 13 in relation to the male roller die 12. The adjustment unit 16 is a linear drive connected to the support structure 15.

Lastly, the tool head 10 also comprises a hem roller 14 mounted rotatably about its roller axis R14. The hem roller 14 is arranged such that either one of the male roller die 12 and the hem roller 14 can selectively be positioned relative to a work piece, e.g. a sheet metal 1 placed on the female die 7, by the movement of the robot arm.

The male roller die 12 and the back-up roller 13 are arranged such that their roller axes R12 and R13 both extend in the same plane. The roller axis R13 is inclined with respect to the roller axis R12. The angle of inclination is not so important with respect to the basic function of the back-up roller 13 but is expediently chosen under the influence of space which is only rarely available on the tool head 10. In principal, the axes R12 and R13 can extend under an angle of inclination of 90°. With respect to function it is more important that a circumferential working surface of the back-up roller 13 is facing the face side of the male roller die 12. In the example embodiment the circumferential working surface, i.e. the rolling surface, of the backup roller 13 is extending perpendicular to the axis R12 of the male roller die 12. The axis R13 of the back-up roller 13 is fixed in relation to the support structure 15, but may be adjustable in it's inclination with respect to the axis R12 in a further development. The working surface of the back-up roller 13 is conical in adaptation to the inclination the roller axis R13 has in relation to the roller axis R12.

Figure 4:
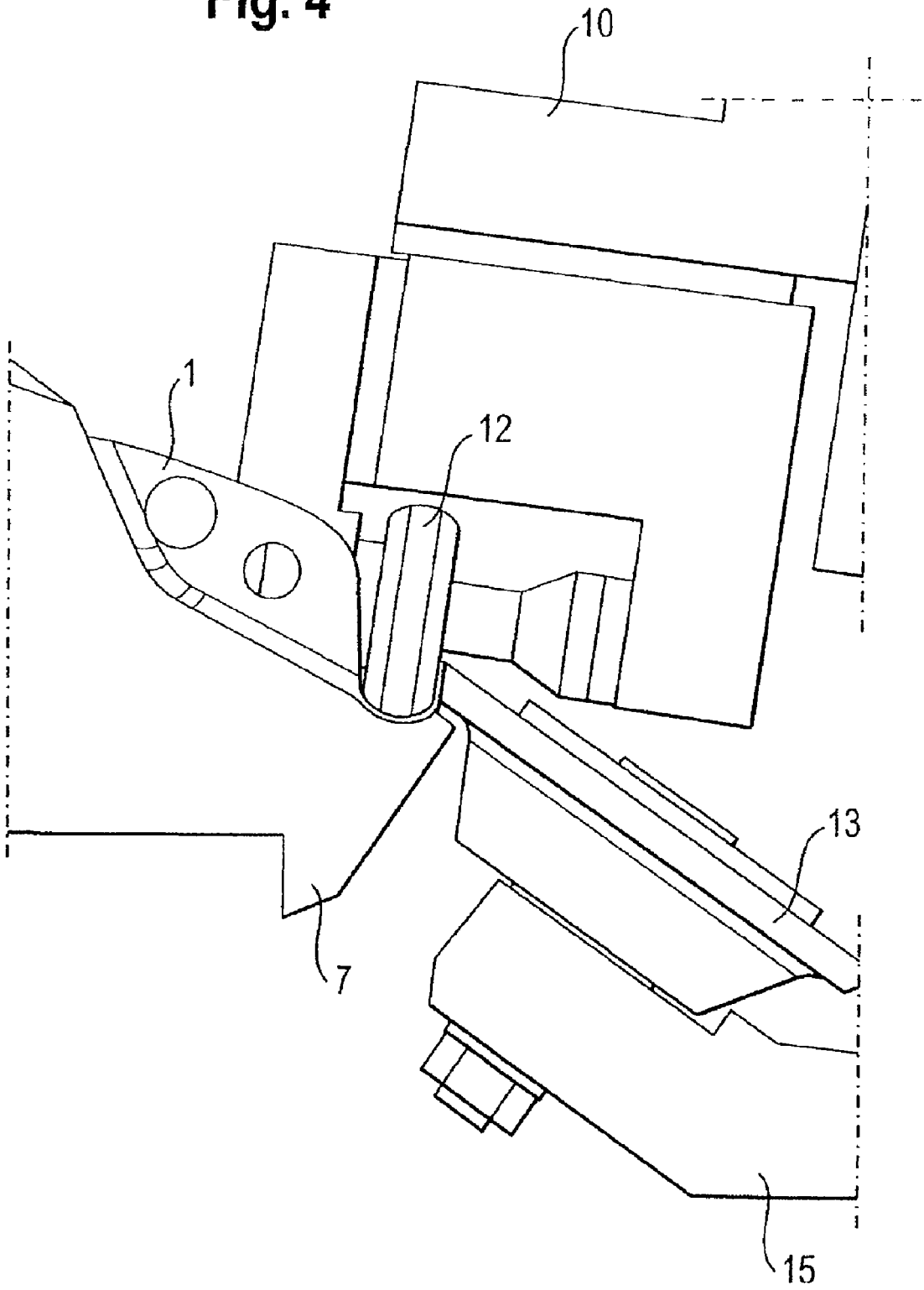
FIG. 4 is a side elevation view of the apparatus of the invention carrying out a roll pass to shape a rim of a sheet metal placed on the female die.

FIG. 4 illustrates co-operation of the female die 7 and the tool head 10 in shaping the rim 2 of a metal sheet 1. Shown is a roll pass of the tool head 10 in which the male roller die 12 is deforming the rim 2 into the chamfer 9 while, at the same time, the back-up roller 13 is backing up an outermost part of the rim 2.

Figure 5:
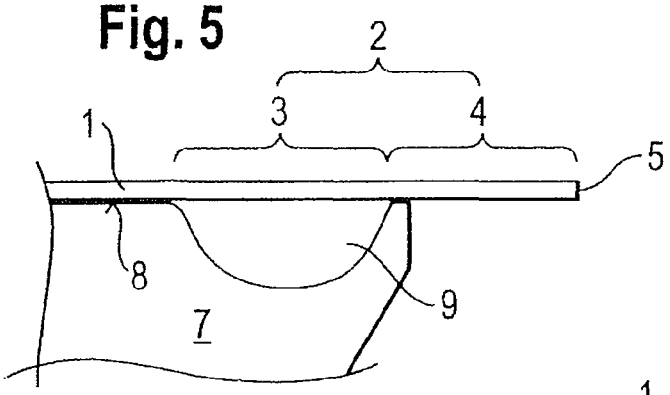
FIGS. 5-9 illustrate shaping of the rim in a sequence of steps according to the invention.

FIGS. 5-9 illustrate a method of shaping the rim 2 in a plurality of roll passes to be carried out sequentially one after the other, thereby roll forming the rim 2 stepwise to the desired shape. FIG. 5 illustrates the first step in which the three-dimensionally arched sheet metal 1 of FIG. 4 is placed on the female die 7 in a forming position in which the rim 2 is following the course of the chamfer 9. The sheet metal 1 is fixed in the forming position, for example by clamping it against the female die 7. In the forming position the rim 2 can virtually be divided in an inner rim zone 3 spanning the chamfer 9 and a peripheral rim zone 4 protruding beyond the chamfer 9. The peripheral rim zone 3 including the peripheral edge 5 protrudes freely from the die 7 which has only a small web forming the side wall of the chamfer 9 adjacent to the peripheral edge 5, this web being small as compared to the width of the chamfer 9.

Figure 6:
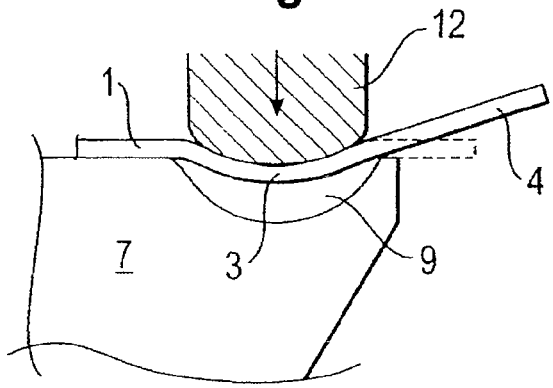

With the metal sheet 1 fixed in the forming position the tool head 10 is moved to a predetermined position and is then applied to the metal sheet 1 such that the male roller die 12 contacts the inner rim zone 3. The male roller die 12 is pressed against the inner rim zone 3 with a pre-determined pressure force and the tool head 10 is moved in space by the robot to roll the male roller die 12 on the inner rim zone 3 following exactly the course of the chamfer 9 with the male roller die 12 pressing the sheet material 1 into the cavity provided by the chamfer 9 with the pre-determined pressure force. The pressure force is selected to deform the sheet metal 1 plastically only to a certain extend, not completely, into the cavity provided by the chamfer 9. If necessary, a second pre-forming roll pass is carried out with the male roller die 12 being in pressing rolling contact with the inner rim zone 3 to deform it deeper into the chamfer 9. While advancing the male roller die 12 in such a pre-forming roll pass, the peripheral rim zone 4 flips up, as indicated in FIG. 6, improving access for the back-up roller 13. The peripheral rim 4 of that portion of the sheet metal 1 which is ahead of the male roller die 12, with respect to its advance direction, is plotted in a dashed line. In the course of a curve of the chamfer 9 the peripheral rim 4 does not flip up so much as it would in a straight section. Furthermore, there is a tendency that wavy distortions develop within the peripheral rim zone 4.

Figure 7:
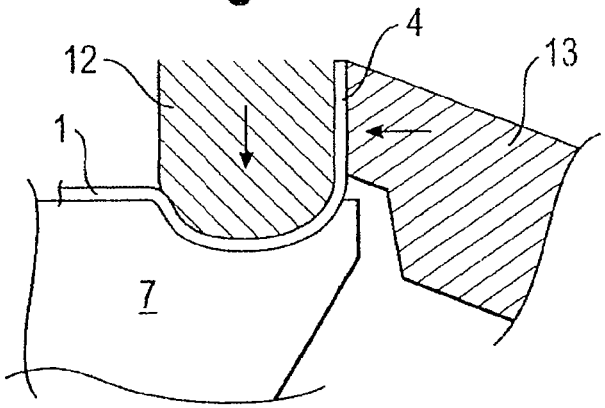

At least in a final roll pass of the male roller die 12, shown in FIG. 7, the back-up roller 13 is also applied against the sheet metal 1. While the male roller die 12 is pressed, in the inner rim zone 3, against a first surface of the sheet metal 1, the back-up roller 13 is pressed, in the peripheral rim zone 4, against an opposed second surface of the peripheral rim zone 4, thereby flanging the peripheral rim zone 4 about a flanging edge which extends between the inner rim zone 3 and the peripheral rim zone 4 along the rim of the chamfer 9. In the final forming pass of the male roller die 12 the sheet material 1 is deformed such that it is in full abutment all over the cross-section of the chamfer 9 to form the rim 2 as a dent 6 corresponding in cross-sectional shape to that of the chamfer 9.

The single or plural pre-forming roll passes may be carried out with only the male roller die 12 being applied to the sheet metal 1. Alternatively, the single or plural pre-forming pass(es) may be carried out with also the back-up roller 13 being applied to avoid development of wavy distortions from the beginning or at least after a first pre-forming roll pass in which the peripheral rim zone 4 is flipped up to some extend to facilitate access for the back-up roller 13.

Figure 8:
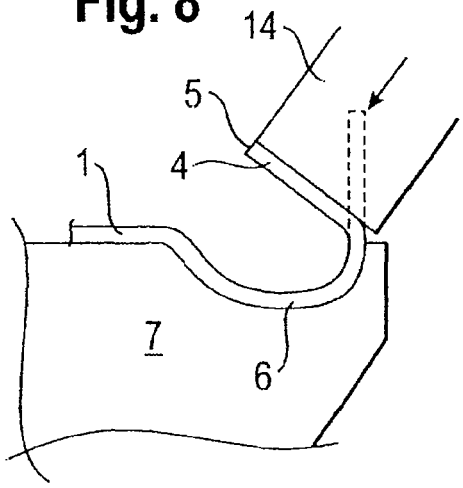

When the male roller die 12 has completed its final forming pass the robot moves the tool head 10 apart to bring the hem roller 13 into a working position. Then the tool head 10 is moved again to a pre-determined position and applied against the sheet metal 1, now with the hem roller 13 coming into contact with the peripheral rim zone 4. The hem roller 13 is pressed against the peripheral rim zone 4, as shown in FIG. 8, and rolled on that zone 4 following the course of the chamfer 9. In this hemming roll pass the peripheral rim zone 4 is flanged towards the chamfer 9, i.e. towards the cavity of the dent 6, the flanging angle being 45°. The peripheral zone 4 which is in front of the hem roller 13 and still in its flipped up position during the first hemming roll pass is plotted in a dashed line.

Figure 9:
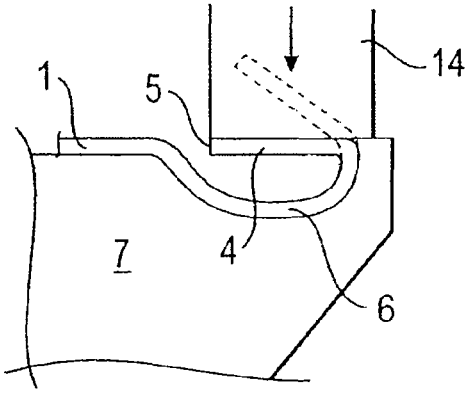

FIG. 9 shows the hem roller 13 during a second roll pass in which the peripheral rim zone 4 is flanged back further about 45°, such that it is flush with the opposing rim of the dent 6 with only a small clearance between that rim and the peripheral edge 5, thereby forming the dent 6 as an almost closed cavity.

The method has been exemplified with two hemming roll passes of the same hem roller 13. Alternatively, the peripheral rim 4 may be flanged back in three or even more hem rolling passes, e.g. in three passes with a flanging angle of 30° each. Furthermore, the tool head 10 may comprise two or more different hem rollers and the hemming roll passes may be carried out with the different hem rollers being applied to the sheet metal 1. Lastly, two or even more hem rollers may be arranged on the tool head 10 as disclosed in EP 06 001 600.3 incorporated herewith by reference. To compensate for back spring, i.e. elasticity of the sheet metal 1, the hem roller 13 or some other hem roller if arranged on the tool head 10, may be applied such that the peripheral edge 4 is flanged back more and over the position in which it is flush with the opposing rim of the dent 6 so that it comes back to the desired position once it is released from the pressure force of flanging.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A method for shaping a rim of a three dimensionally arched sheet metal comprising:

positioning the sheet metal on a female die provided with a chamfer which follows the contour of a peripheral edge of the rim, the rim spanning the chamfer; and rolling a male roller die on the sheet metal following the course of the chamfer while being pressed against the rim, thereby plastically deforming the rim locally into the chamfer while advancing along the chamfer in rolling contact, wherein the rim comprises an inner rim zone spanning the chamfer and a peripheral rim zone which includes the peripheral edge and protrudes beyond the chamfer, and, after having deformed the inner rim zone into the chamfer, the outer rim zone is bent back towards the deformed inner rim zone, wherein a back-up roller is rolled along the peripheral rim zone pressed against the peripheral rim zone towards the male roller die, thereby backing up the peripheral rim zone, while the male roller die is pressed in rolling contact against the inner rim zone and the peripheral rim zone is backed-up by the back-up roller and thereafter bent back towards the deformed inner rim zone.

2. Method according to claim 1, wherein the rim is deformed into the chamfer in at least one pre-forming roll pass and a final forming roll pass in which the rim is pressed and deformed deepest into the chamfer.

3. Method according to claim 2, wherein the peripheral rim zone is backed-up by the back-up roller in the final roll pass.

4. Method according to claim 2, wherein the forming roll passes are carried out with the same male roller die.

5. Method according to claim 1, wherein the sheet metal component is of or for a vehicle.

6. A method for shaping a rim of a three dimensionally arched sheet metal comprising:

positioning the sheet metal on a female die provided with a chamfer which follows the contour of a peripheral edge of the rim, the rim spanning the chamfer; and rolling a male roller die on the sheet metal following the course of the chamfer while being pressed against the rim, thereby plastically deforming the rim locally into the chamfer while advancing along the chamfer in rolling contact, wherein the rim comprises an inner rim zone spanning the chamfer and a peripheral rim zone which includes the peripheral edge and protrudes beyond the chamfer, and, after having deformed the inner rim zone into the chamfer, the outer rim zone is bent back towards the deformed inner rim zone, wherein the peripheral rim zone is bent back by means of a hem roller pressed against the peripheral rim zone and advanced in rolling contact along the peripheral rim zone.

7. Method according to claim 6, wherein the peripheral rim zone is bent back successively further in at least two passes of roll hemming.

8. Method according to claim 6, wherein the sheet metal component s of or for a vehicle.

9. Method according to claim 6, wherein a back-up roller is rolled along the peripheral rim zone pressed against the peripheral rim zone towards the male roller die, thereby backing up the peripheral rim zone, while the male roller die is pressed in rolling contact against the inner rim zone.

10. Method according to claim 6, wherein the rim is deformed into the chamfer in at least one pre-forming roll pass and a final forming roll pass in which the rim is pressed and deformed deepest into the chamfer.

11. Method according to claim 10, wherein the peripheral rim zone is backed-up by the back-up roller in the final roll pass.

12. Method according to claim 10, wherein the forming roll passes are carried out with the same male roller die.

13. A method for shaping a rim of a three dimensionally arched sheet metal comprising:

positioning the sheet metal on a female die provided with a chamfer which follows the contour of a peripheral edge of the rim, the rim spanning the chamfer; and rolling a male roller die on the sheet metal following the course of the chamfer while being pressed against the rim, thereby plastically deforming the rim locally into the chamfer while advancing along the chamfer in rolling contact, wherein the rim comprises an inner rim zone spanning the chamfer and a peripheral rim zone which includes the peripheral edge and protrudes beyond the chamfer, and, after having deformed the inner rim zone into the chamfer, the outer rim zone is bent back towards the deformed inner rim zone, wherein the peripheral rim zone is bent back so far that it spans, at least partially, a dent of the sheet metal which has been formed by deforming the inner rim zone into the chamfer.

14. Method according to claim 13, wherein the peripheral rim zone is bent back so far that the peripheral edge, after releasing the inner rim zone from any force, does at least overlap with a rim of the dent.

15. Method according to claim 13, wherein a back-up roller is rolled along the peripheral rim zone pressed against the peripheral rim zone towards the male roller die, thereby backing up the peripheral rim zone, while the male roller die is pressed in rolling contact against the inner rim zone.

16. Method according to claim 13, wherein the rim is deformed into the chamfer in at least one pre-forming roll pass and a final forming roll pass in which the rim is pressed and deformed deepest into the chamfer.

17. Method according to claim 16, wherein the peripheral rim zone is backed-up by the back-up roller in the final roll pass.

18. Method according to claim 16, wherein the forming roll passes are carried out with the same male roller die.

19. Method according to claim 13, wherein the sheet metal component is of or for a vehicle.

* * * * *